United States Patent [19]

Rostik

[11] Patent Number: 4,744,406

[45] Date of Patent: May 17, 1988

[54] HORIZONTAL CONTINUOUS CASTING APPARATUS WITH BREAK RING FORMED INTEGRAL WITH MOLD

[75] Inventor: Libor F. Rostik, Duncanville, Tex.

[73] Assignee: Chaparral Steel Company, Midlothian, Tex.

[21] Appl. No.: 924,638

[22] Filed: Oct. 30, 1986

[51] Int. Cl.[4] ..... B22D 11/04; B22D 11/10

[52] U.S. Cl. ..... 164/440; 164/490

[58] Field of Search ..... 164/440, 490

[56] References Cited

U.S. PATENT DOCUMENTS

| | | | |
|---|---|---|---|
| 4,113,002 | 9/1978 | Fukuta et al. | 164/138 X |
| 4,175,611 | 11/1979 | Fletcher | 164/138 X |
| 4,340,110 | 7/1982 | Honda et al. | 164/440 X |

FOREIGN PATENT DOCUMENTS

| | | | |
|---|---|---|---|
| 3109715 | 9/1982 | Fed. Rep. of Germany | 164/440 |
| 56-84157 | 7/1981 | Japan | 164/440 |
| 59-97746 | 6/1984 | Japan | 164/440 |

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A mold for use in the horizontal continuous casting of molten material has an integral break ring. The break ring is produced by thermal spraying refractory material onto the surface of the mold to bond the refractory material and solidify it to integrally form the break ring.

6 Claims, 1 Drawing Sheet

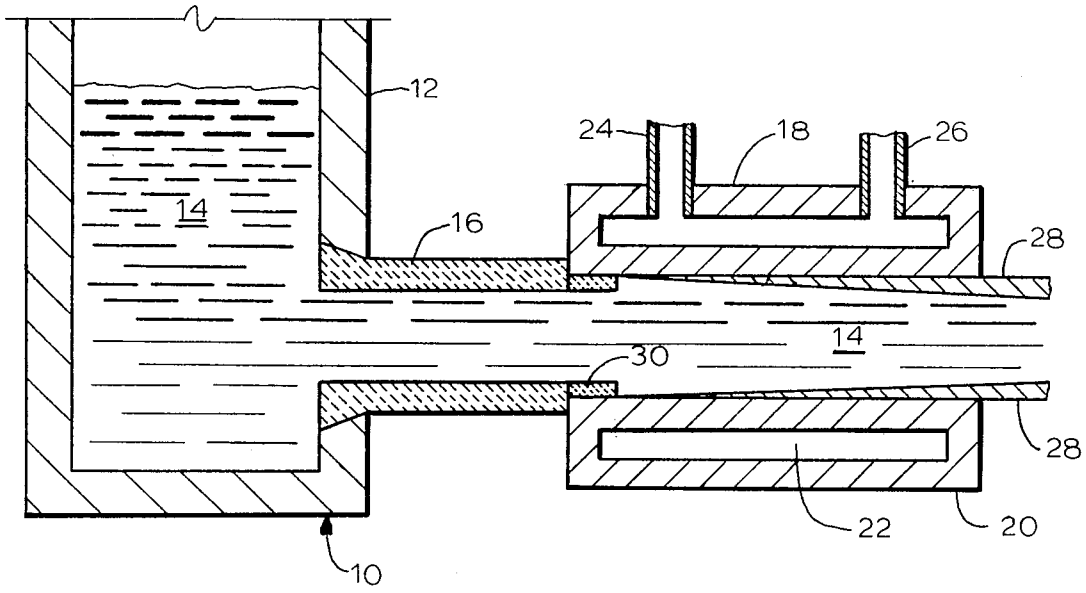
10
12
14
16
18
20
22
24
26
28
28
30
14

HORIZONTAL CONTINUOUS CASTING APPARATUS WITH BREAK RING FORMED INTEGRAL WITH MOLD

BACKGROUND OF THE INVENTION

In the continuous casting of molten material, particularly metals and alloys such as steel, the apparatus for this purpose includes a tundish for receiving the molten material to be cast. The tundish has a refractory, horizontally disposed nozzle through which the molten metal leaves the tundish for casting. The nozzle at the end opposite that connected to the tundish is connected to a flow-through continuous casting mold. The continuous casting mold is made of a heat-conducting material, usually copper, and provision is made for circulation of liquid, usually water, to cool the mold. As the molten metal enters the mold and contacts the cooled, interior mold surfaces, it is solidified to form a solidified skin of the molten metal with the interior portion remaining in the molten condition. The thickness of the solidified skin increases progressively along the length of the mold. As this partially solidified or embryo casting leaves the mold, the skin is sufficiently thick to prevent the breakout of molten metal. Thereafter, the embryo casting is progressively cooled and eventually complete solidification of the casting is achieved.

The refractory material of the nozzle which is in contact with the molten metal leaving the tundish is at extremely high temperatures. In contrast, the mold abutting the refractory nozzle is at significantly lower temperatures. Consequently, it is conventional practice to place on the interior of the mold a break ring to serve as a transition material between the refractory of the nozzle and the heat-conducting material of the cooled mold. The break ring functions to define the point at which the shell of the casting begins to form when the molten metal initially enters the mold. It prevents solification and hang-up of the metal at the end of the nozzle at the interface of the nozzle and mold. More specifically in this regard, as is well known, relative oscillation or vibration of the mold and casting is provided longitudinally to facilitate withdrawal of the partially solidified casting from the mold. If metal enters and solidifies at the interface or connection between the nozzle and mold a solidified metal projection, commonly termed a "fin", is formed. This during withdrawal results in surface irregularities on the casting skin, which can cause cracking with resulting molten metal break-out. In addition, the break ring prevents the molten metal from freezing within the pores of the refractory material adjacent the continuous casting mold. In summary, the break ring prevents damage to the newly formed solidified casting skin at the entry end of the mold. For this purpose, and particularly in the continuous casting of molten alloys such as steel, the break ring must have chemical resistance to the steel, high resistance to thermal shock, low thermal conductivity, high resistance to wear and erosion and accurately conform to the surface on which it is mounted. To meet these requirements, the break ring is conventionally constructed from refractory oxides or nitrides, such as boron nitride, silicon nitride and zirconia, and is machined to the proper contour to achieve the required accurate mounting.

The continuous casting mold in typical steel casting operations is of a generally round and/or rectangular configuration to permit the casting of slabs or billets which are subsequently reduced to flat-rolled sheet and strip or bars, respectively. Consequently, the interior cross section of the continuous casting mold must conform to this desired configuration. Each mold, however, due to inaccuracies in construction will vary somewhat in dimension. Therefore, the break ring requires machining to very close tolerances to mate with the interior of the continuous casting mold. If the break ring is not accurately dimensioned with respect to the mold interior onto which it is mounted, this will result in the molten metal propagating between the connection of the break ring and the mold interface surface.

OBJECTS OF THE INVENTION

It is accordingly a primary object of the present invention to provide a break ring that is integral with the continuous casting mold to eliminate machining requirements to achieve the required fitting of the break ring to the mold.

BRIEF DESCRIPTION OF THE DRAWING

The single FIGURE of the drawing is a somewhat schematic view in vertical cross section of a portion of a continuous casting apparatus with an embodiment of applicants's break ring employed therewith.

This drawing which is incorporated in and constitutes a part of this specification illustrates an embodiment of the invention and together with the description serves to explain the principles of the invention.

SUMMARY OF THE INVENTION

The invention relates to an apparatus for the horizontal continuous casting of molten material, such as metals and alloys, including steel. The apparatus includes a tundish for receiving a quantity of the molten material to be cast. A refractory nozzle is provided as a molten material outlet from the tundish to a flow-through mold of heat-conducting material having an inlet end contacting the nozzle for receiving the molten material and an outlet end for discharging an embryo casting of the molten material. The embryo casting results from cooling of the molten material during passage through the mold. In accordance with the invention, a break ring is provided integral with the mold at the inlet end thereof.

The break ring may comprise a refractory compound. The refractory compound forms a bond with the heat-conducting material of the mold. Preferably, the heat-conductive material of the mold is copper or a copper alloy. In addition, preferably the refractory compound is zirconia or a zirconia compound.

The break ring is preferably formed by providing a plurality of layers of the refractory compound each solidified on the mold to form the break ring.

With respect to the method of the invention, such includes thermal spraying, such as conventional plasma spraying, the refractory material onto the surface of the mold to bond it to the surface and solidify it thereon to integrally form the break ring on the surface of the mold. Preferably, a plurality of layers of the refractory material are thermal sprayed for this purpose. A bond with the mold is formed as a result of the thermal spraying of the refractory material.

DESCRIPTION OF THE PREFERRED EMDBODIMENTS

With respect to the single FIGURE of the drawing, there is shown an assembly of a portion of a continuous, horizontal steel casting apparatus, designated generally as 10. The apparatus includes a tundish 12 containing therein a quantity of molten steel 14. A refractory nozzle 16 is connected at an outlet end to the interior of the tundish 12 and at the other end to a horizontally disposed copper continuous casting mold 18. The mold 18 has a generally round and/or rectangular configuration and constitutes a copper body portion 20 having an interior water circulation chamber 22 communicating with water inlet 24 and water outlet 26. This structure provides for the circulation of water through the chamber to cool the mold. As the molten metal 14 enters the mold 18 and contacts the copper water-cooled mold body 20 it begins to solidify to form a solidified skin 28 with the interior constituting the molten metal 14.

In accordance with the invention, a break ring, designated as 30, is provided on the interior surface of the mold 18 and specifically to the mold body 20 thereof. The break ring 30 is positioned at the interface of the nozzle 16 and the mold 18. It functions in the well known manner to prevent penetration of the molten steel into the refractory of the nozzle and also to prevent hang up of the steel at the junction between the nozzle and the continuous casting mold. For this purpose, and in addition to prevent molten steel from entering into the contact surfaces of the break ring and the mold body 20, the break ring is formed integral with the continuous casting mold with a bond between the break ring and the mold surface. The break ring may preferably be zirconia or a zirconia compound.

Although the break ring 30 is shown having a cross section of generally rectangular configuration, other cross sectional shapes may be used and are well known in the art. For example, the surface of the break ring in contact with the molten metal may be rounded or slanted rather than being at right angles as shown in the embodiment of the drawing. Also, as is well known in the art, the break ring may be positioned other than as shown in the FIGURE. For example, it may be on the outer end surface of the mold adjacent the nozzle.

The integral break ring 30 is formed by conventional thermal spraying, such as plasma spraying of the refractory compound. Plasma spraying, as is well known, constitutes providing a powder charge of the refractory compound to be used in the manufacture of the integral breaker ring. The powder charge is introduced to a high-temperature gas plasma which melts the particles and sprays them onto the surface to be coated with the refractory compound, which in accordance with the instant invention is the portion of the continuous casting mold interior wherein the break ring is to be integrally formed. Spraying of the refractory compound to deposit the same on this surface is achieved by accelerating the molten refractory compound by the plasma arc. Although various techniques are known for this purpose and the invention embodies any equivalent practice, various conventional thermal spraying practices suitable for use in the practice of the invention are disclosed in the article "Tomorrows Surface Coatings," *Iron Age,* June 21, 1985, pages 35–49.

Consequently, thermal spraying in accordance with the practice of the invention may be defined as any practice wherein the refractory compound from which the break ring is to be integrally formed on the continuous casting mold interior may be heated to the molten state and sprayed with sufficient accuracy to deposit the same at the intended location and to achieve upon solidification a bond between the material of the surface on which it is deposited and the refractory compound. Typically, the plasma spraying involves depositing by this practice a plurality of layers of the refractory compound and allowing each to solidify until a break ring of sufficient thickness and configuration is achieved. After the plasma spraying of the refractory compound to form a break ring of the desired thickness and configuration, a light machining operation may be performed to achieve the desired final configuration of the break ring. It may be seen, however, that no machining is required to achieve the proper fitting of the break ring to the interior of the continuous casting mold, as this is achieved by the integral construction practice in accordance with the invention.

Although the break ring may be of various thicknesses depending upon the particular continuous casting equipment with which it is used, typically the thickness may be on the order of 0.5 to 25 mm. If required, each layer of the deposited refractory compound may be heat treated after application and cooling to reduce any thermal stresses resulting during the high temperature plasma spraying operation. Also, for purposes of improving thermal shock resistance of the break ring it may be desirable to use undercoatings as transition layers. The use of transition layers for this purpose is well known in the thermal spraying art.

It may be seen that the invention provides a low cost and yet efficient practice for constructing horizontal continuous casting apparatus, and particularly a casting mold having a break ring integral therewith. In this manner, the prior-art requirements of close-tolerance machining to achieve the required fit between the break ring and the interior of the continuous casting mold are avoided. This, of course, results in an improved break ring-continuous casting mold structure while reducing the manufacturing costs.

Since the break ring does not require masking to correspond with the configuration of the continuous casting mold, it is possible to have molds designed to cast product shapes heretofore not practical. Specifically, the mold may be of relatively narrow cross-section to provide for casting of long, narrow slabs or strips. Also, the mold may be designed to cast cross-sectional shapes other than rectangular and round, such as I-beam shapes. These applications are not practical if the break ring is required to be machined as opposed to being formed integral with the mold as by thermal spraying in accordance with the invention.

What is claimed is:

1. In an apparatus for the horizontal continuous casting of molten material including a tundish for receiving a quantity of molten material, such as molten metals and alloys, to be cast, a refractory nozzle providing a molten material outlet from said tundish and a flow-through mold of heat-conducting material having an inlet end contacting said nozzle for receiving said molten material therefrom and an outlet end for discharging an embryo casting resulting from cooling of said molten material during passage through said mold, the improvement comprising a break ring formed integral with said mold at the inlet end thereof and without any intermediate bonding material between the break ring and the mold.

2. The apparatus of claim 1 wherein said break ring comprises a refractory compound.

3. The apparatus of claim 2 wherein said break ring comprises a refractory compound forming a bond with said heat-conducting material of said mold.

4. The apparatus of claim 1 wherein said heat-conducting material of said mold is copper or a copper alloy.

5. The apparatus of claim 3 wherein a plurality of layers of said refractory compound are each solidified on said mold to form said break ring.

6. The apparatus of claim 5, wherein said refractory compound is zirconia or a zirconia compound.

* * * * *

UNITED STATES PATENT AND TRADEMARK OFFICE

Certificate

Patent No. 4,744,406

Patented: May 17, 1989

On motion pursuant to 37 CFR 1.634 in Interference No. 102,038, it has been found that the above-identified patent, through error and without any deceptive intention, incorrectly sets forth the inventorship. Accordingly, pursuant to 35 U. S. C. 256 it is hereby certified that the correct inventorship on this patent is Libor F. Rostik and Robert C. Tucker, Jr.

Signed and Sealed this Third Day of October, 1989

JAMES R. BOLER
*Examiner-in-Chief*
*Board of Patent Appeals*
*and Interferences*